US011037505B2

(12) United States Patent
Shin

(10) Patent No.: US 11,037,505 B2
(45) Date of Patent: Jun. 15, 2021

(54) FLAT PANEL DISPLAY DEVICE INCLUDING MULTIPLEXER

(71) Applicant: LG Display Co., Ltd., Seoul (KR)

(72) Inventor: Cheon-Kee Shin, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/705,220

(22) Filed: Dec. 5, 2019

(65) Prior Publication Data

US 2020/0193914 A1 Jun. 18, 2020

(30) Foreign Application Priority Data

Dec. 13, 2018 (KR) ..... 10-2018-0160727

(51) Int. Cl.
*G09G 3/3275* (2016.01)
*G09G 3/36* (2006.01)

(52) U.S. Cl.
CPC ..... *G09G 3/3275* (2013.01); *G09G 3/3688* (2013.01); *G09G 2310/0297* (2013.01); *G09G 2310/08* (2013.01)

(58) Field of Classification Search
CPC ..... G09G 3/3275; G09G 3/3688; G09G 2310/08; G09G 2310/0297; G09G 2330/06; G09G 3/3208; G09G 3/3677
See application file for complete search history.

(56) References Cited

U.S. PATENT DOCUMENTS

2014/0232626 A1* 8/2014 Jamshidi-Roudbari ..... G09G 3/3688 345/92
2014/0267218 A1* 9/2014 Pai ..... G09G 3/20 345/214
2018/0293943 A1* 10/2018 Hong ..... G09G 3/3266
2019/0027102 A1* 1/2019 Hong ..... H03K 5/135
2019/0204981 A1* 7/2019 Lee ..... G06F 3/0412
2019/0213940 A1* 7/2019 Veidhes ..... G02F 1/133345

* cited by examiner

*Primary Examiner* — Temesghen Ghebretinsae
*Assistant Examiner* — Ivelisse Martinez Quiles
(74) *Attorney, Agent, or Firm* — Fenwick & West LLP

(57) ABSTRACT

Disclosed herein is a flat panel display device capable of reducing switching noise and electromagnetic interference noise caused by driving of a multiplexer and stabilizing a common voltage in an in-cell touch flat panel display device. Discloses is a multiplexer controlled by k MUX control signals and k pseudo MUX control signals to selectively supply the data signal supplied from each output channel of the data driving circuit to k data lines. The multiplexer includes k pairs of switching transistors. Each pair of switching transistors include a first switching transistor controlled by one of the k MUX control signals to supply a data signal output from the one output channel of the data driving circuit to one data line, and a second switching transistor controlled by one of the k pseudo MUX control signals having a phase opposite to that of the one of the k MUX control signals.

17 Claims, 4 Drawing Sheets

FLAT PANEL DISPLAY DEVICE INCLUDING MULTIPLEXER

CROSS-REFERENCE TO RELATED APPLICATIONS

This application claims the benefit of Korean Patent Application No. 10-2018-0160727, filed on Dec. 13, 2018, which is hereby incorporated by reference as if fully set forth herein.

BACKGROUND OF THE INVENTION

Field of the Invention

The present invention relates to a flat panel display device for reducing noise caused by driving of a multiplexer.

Discussion of the Related Art

As an information-oriented society has been developed and various types of portable electronic devices such as mobile communication terminals and laptops have been developed, demand for a flat panel display device applicable thereto is gradually increasing.

As a flat panel display device, a liquid crystal display (LCD) device using liquid crystal and an organic light emitting diode (OLED) display device using an OLED may be used.

Such a flat panel display device includes a display panel including a plurality of gate lines and a plurality of data lines in order to display an image and a driving circuit for driving the display panel.

Among the above-described display devices, in the display panel of the OLED display device, subpixels are defined by intersections between a plurality of gate lines and a plurality of data lines, and each subpixel includes an OLED including an anode, a cathode and an organic light emitting layer between the anode and the cathode, and a pixel circuit for independently driving the OLED.

The pixel circuit may be variously configured and includes at least one switching TFT, a capacitor and a driving TFT.

The at least one switching TFT stores a data voltage in the capacitor in response to a scan pulse. The driving TFT controls the amount of current supplied to the OLED according to the data voltage stored in the capacitor, thereby controlling the amount of light emitted from the OLED.

In addition, among the above-described display devices, the LCD device is a device for displaying an image by controlling light transmittance of liquid crystal using an electric field and the display panel of the LCD display device includes a lower substrate and an upper substrate facing each other and a liquid crystal layer filled between the lower substrate and the upper substrate.

On the upper surface of the lower substrate, the plurality of gate lines and the plurality of data lines are arranged to cross each other to define a plurality of pixel regions, and a thin film transistor and a pixel electrode are formed in each pixel region. On the rear surface of the upper substrate, a color filter layer implementing a color in the plurality of pixel regions, a black matrix for preventing light leakage in regions corresponding to the outside of the plurality of pixel regions and a common electrode for applying a common voltage are formed. The common electrode may be formed on the lower substrate according to the model.

In the liquid crystal display device having such a configuration, a transistor corresponding to each pixel is selectively turned on in response to a gate signal applied to each gate line, a data voltage of a data line is applied to each pixel electrode, a predetermined electric field is generated between the pixel electrode and the common electrode by the common voltage applied to the common electrode and the data voltage applied to the pixel electrode, and light transmittance, that is, luminance, of the liquid crystal layer is controlled by the generated electric field in each pixel region, thereby displaying an image.

In addition, the driving circuit for driving the display panel includes a gate driving circuit for sequentially supplying a scan signal (gate signal) to the plurality of gate lines of the display panel, a data driving circuit for supplying a data voltage to the plurality of data lines of the display panel, and a timing controller for supplying image data and various types of control signals to the gate driving circuit and the data driving circuit.

In such flat panel display devices, since the data driving circuit supplies the data voltage to each pixel region when the scan signal is applied by the gate driving circuit, each pixel region expresses a gray scale according to the data voltage, thereby displaying an image.

The data driving circuit includes a plurality of data integrated circuits D-IC. When each output channel of each data integrated circuit drives one data line DL, a plurality of data integrated circuits corresponding in number to the number of data lines needs to be provided, thereby increasing manufacturing cost. In particular, as the size and resolution of the display panel increase, such a problem becomes serious.

Accordingly, a multiplexer for distributing one output of the data driving circuit to several data lines is provided between the data driving circuit (the plurality of data integrated circuits) and the data lines, thereby reducing the number of data integrated circuits and manufacturing costs. That is, since the number of outputs of the data driving circuit is reduced by the multiplexer, it is possible to simplify the data driving circuit.

However, since a multiplexer driving control signal for driving the multiplexer swings with a high frequency, switching noise and electromagnetic interference (EMI) noise frequently occur. In addition, it is difficult to achieve communication sensitivity and a set of frequency avoidance regions.

In addition, in the case of an in-cell touch flat panel display device, image quality defects caused by common voltage stabilization delay are generated by the multiplexer driving control signal.

SUMMARY OF THE INVENTION

An object of the present invention is to provide a flat panel display device capable of reducing switching noise and electromagnetic interference caused by driving of a multiplexer and stabilizing a common voltage in an in-cell touch flat panel display device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a flat panel display device includes a multiplexer controlled by k (k being a natural number equal to or greater than 2) MUX control signals and k pseudo MUX control signals to selectively supply data signals from each output channel of the data driving circuit to k data lines, wherein the multiplexer includes k pairs of switching transistors, each pair of switching transistors comprising a first switching transistor controlled by one of the k MUX control signals to supply a data signal output from the one output channel of the data driving circuit to one data line, and a second switching transistor controlled by one of the k pseudo MUX control signals having a phase opposite to that of the one of the k MUX control signals.

In some embodiments, for each pair of switching transistors, a drain electrode of a first switching transistor and a drain electrode of a second switching transistor may be connected to each other and to a corresponding data line, one of the k MUX control signals may be applied to a gate electrode of the first switching transistor, one of the k pseudo MUX control signals is applied to a gate electrode of the second switching transistor, a source electrode of the first switching transistor is connected to the one output channel of the data driving circuit, and a source electrode of the second switching transistor is floating.

A falling edge of a first MUX control signal and a rising edge of a second MUX control signal, which are adjacent to each other, of the k MUX control signals may have a predetermined time interval.

The MUX control signal and the pseudo MUX control signal may have the same frequency.

A falling edge and a rising edge of the MUX control signal respectively coincide with a rising edge and falling edge of the pseudo MUX control signal.

A rising edge and a falling edge of the MUX control signal may be cancelled by the pseudo MUX control signal.

Signal lines for supplying the MUX control signal and the pseudo MUX control signal may be formed on a non-display region of the display panel in a line on glass (LOG) type.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
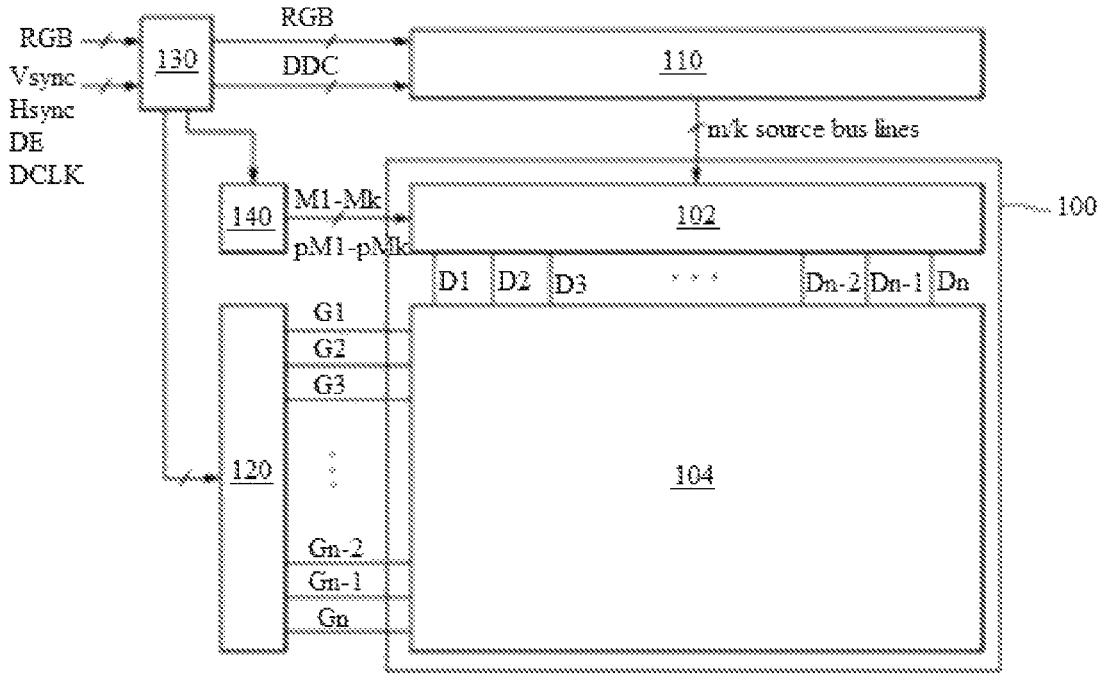
FIG. 1 is a schematic block diagram showing a flat panel display device according to an embodiment of the present invention.

The advantages and features of the present invention and the way of attaining them will become apparent with reference to embodiments described below in detail in conjunction with the accompanying drawings. Embodiments, however, may be embodied in many different forms and should not be constructed as being limited to example embodiments set forth herein. Rather, these example embodiments are provided so that this disclosure will be through and complete and will fully convey the scope to those skilled in the art. The scope of the present invention should be defined by the claims.

The shapes, sizes, ratios, angles, numbers, and the like, which are illustrated in the drawings in order to describe various embodiments of the present invention, are merely given by way of example, and therefore, the present invention is not limited to the illustrations in the drawings. The same or extremely similar elements are designated by the same reference numerals throughout the specification. In addition, in the description of the present invention, a detailed description of related known technologies will be omitted when it may make the subject matter of the present invention rather unclear.

In the present specification, when the terms "comprises", "includes", "have" and the like are used, other elements may be added unless the term "only" is used. An element described in the singular form is intended to include a plurality of elements unless the context clearly indicates otherwise.

In the interpretation of constituent elements included in the various embodiments of the present invention, the constituent elements are interpreted as including an error range even if there is no explicit description thereof.

In the description of the various embodiments of the present invention, when describing positional relationships, for example, when the positional relationship between two parts is described using "on", "above", "below", "aside", or the like, one or more other parts may be located between the two parts unless the term "directly" or "closely" is used.

In the description of the various embodiments of the present invention, although terms such as, for example, "first" and "second" may be used to describe various elements, these terms are merely used to distinguish the same or similar elements from each other.

The respective features of the various embodiments of the present invention may be partially or wholly coupled to and combined with each other, and various technical linkage and driving thereof are possible. These various embodiments may be performed independently of each other, or may be performed in association with each other.

FIG. 1 is a schematic block diagram showing a flat panel display device according to an embodiment of the present invention. The flat panel display device of FIG. 1 may be a liquid crystal display device or an organic light emitting diode (OLED) display device.

As shown in FIG. 1, the flat panel display device according to the present invention includes a display panel 100, a multiplexer 102, a data driving circuit 110, a gate driving circuit 120, a timing controller 130 and a MUX control signal generation circuit 140.

The display panel 100 may be a liquid crystal display panel or an OLED display panel.

The display panel 100 is divided into a display region 104 for displaying an image and a non-display region. In the display region 104, a plurality of data lines D1 to Dm and a plurality of gate lines G1 to Gn are disposed to cross each other and m×n (m and n being positive integers) subpixels are disposed in a matrix. The multiplexer 102 is disposed in the non-display region of the display panel 100.

If the display panel 100 is a liquid crystal display panel, liquid crystal is injected between a lower substrate and an upper substrate, the data lines DL1 to DLm and the gate lines GL1 to GLn are formed on the lower substrate to cross each other, the plurality of subpixel regions is defined in the crossing regions, and a thin film transistor and a pixel electrode are formed in each subpixel region.

The thin film transistor supplies the data signal of each of the data lines DL1 to DLm to the pixel electrode in response to a scan signal supplied to each of the gate lines GL1 to GLn. The gate electrode of the thin film transistor (TFT) is connected to the gate line GL, the source electrode thereof is connected to the data line DL, and the drain electrode thereof is connected to the pixel electrode.

In addition, a storage capacitor is formed in the pixel region of the liquid crystal display panel to constantly maintain a voltage applied to liquid crystal.

If the display panel 100 is an OLED display panel, the data lines DL1 to DLm and the gate lines GL1 to GLn are formed on a substrate to cross each other, a plurality of subpixel regions is defined in the cross regions, each subpixel region includes an OLED including an anode, a cathode and an organic light emitting layer between the anode and the cathode, and a pixel circuit for independently driving the OLED. The pixel circuit may be variously configured and includes at least one switching TFT, a capacitor and a driving TFT.

In addition, the subpixels include a plurality of red (R) subpixels for implementing red, a plurality of green (G) subpixels for implementing green, and a plurality of blue (B) subpixels for implementing blue. Additionally, a plurality of white (W) subpixels may be further included in order to improve luminance.

The timing controller 130 generates a gate control signal and a data control signal using synchronization signals supplied from an external system. The gate control signal includes a gate start pulse (GSP), a gate shift clock (GSC) and a gate output enable (GOE) signal. The data control signal (DCS) includes a source start pulse (SSP), a source shift clock (SSC), a source output enable (SOE) signal and a polarity (POL) signal.

In addition, the timing controller 130 realigns digital data input thereto and supplies the aligned data to the data driving circuit 110.

The gate driving circuit 120 may include a plurality of gate integrated circuits and sequentially generates n scan signals (gate high signals) in response to the gate control signal from the timing controller 130. A gate low voltage (e.g., ground (GND) voltage) is supplied to the gate lines GL1 to GLn which are not driven. Each gate integrated circuit includes a shift register for sequentially generating the scan signal (gate high signal) in response to the gate start pulse (GSP) and the gate shift clock (GSC) supplied from the timing controller 130 and a level shifter for shifting the voltage of the scan signal to a level suitable for driving the pixel.

The data driving circuit 110 may include a plurality of data integrated circuits. Each data integrated circuit outputs a data voltage of one line through m/k output channels (m/k source bus lines) in a horizontal period in response to the data control signal supplied from the timing controller 130. Wherein "m" corresponds to the number of data lines of the display panel 100, and "k" is a natural number equal to or greater than 2.

Specifically, the data driving circuit 110 shifts the source start pulse (SSP) according to the source shift clock (SSC) to generate a sampling signal, although not shown in the figure. Subsequently, in response to the sampling signal, the digital data received from the timing controller 130 is sequentially received and latched in predetermined units. In addition, the latched digital data of one line is converted into an analog data signal using a digital-to-analog converter and a gamma voltage and is output through the m/k output channels according to the source output enable (SOE) signal.

Here, the data driving circuit 130 may perform conversion into a positive (+) or negative (−) analog data voltage in response to the polarity signal and output the converted voltage.

The multiplexer 102 is connected between the m/k output channels and m data lines D1 to Dm to time-divisionally distribute the data voltages output from the output channels to the data lines D1 to Dm with a ratio of 1:k. For example, the multiplexer 102 distributes the data voltages with the ratio of 1:k in response to k (N is a positive integer and 2≤k) MUX control signals of the MUX control signals M1 to Mk.

That is, the data voltages may be distributed with a ratio of 1:2 in response to two MUX control signals M1 and M2, may be distributed with a ratio of 1:3 in response to three MUX control signals M1, M2 and M3 or may be distributed with a ratio of 1:k in response to k MUX control signals M1, M2, . . . , Mk.

The multiplexer 102 may distribute the data voltages output from the m/k output channels to m data lines D1 to Dm, thereby reducing the number of output channels of the data driving circuit 110 by k times as compared to the number of data lines.

The MUX control signal generation circuit 140 generates the MUX control signals M1 to Mk for controlling the turn-on times of the switching elements included in the multiplexer 102, under control of the timing controller 130.

The multiplexer 102 is formed simultaneously with the elements formed in the subpixel regions of the display region of the display panel 100.

On the display panel 100, touch sensors may be further disposed.

The multiplexer 102 will now be described in detail.

Figure 2:
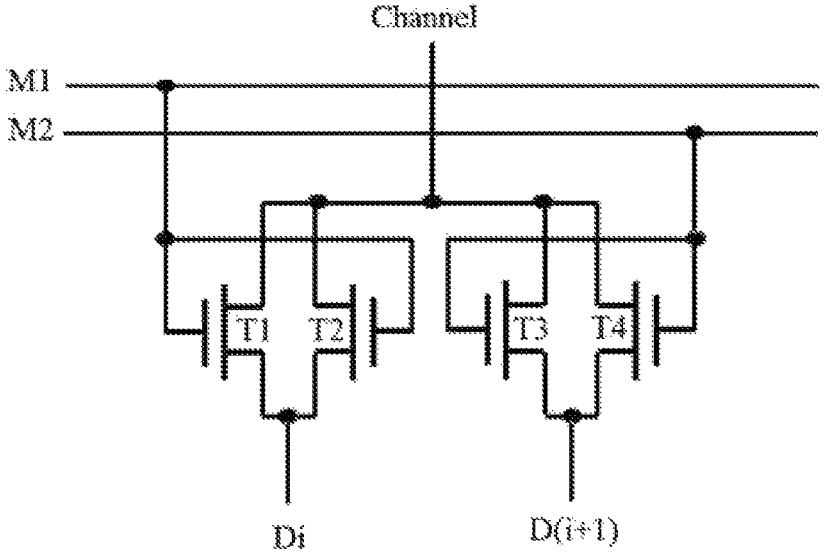
FIG. 2 is a circuit diagram of a multiplexer of a flat panel display device according to a first embodiment of the present invention.
Figure 3:
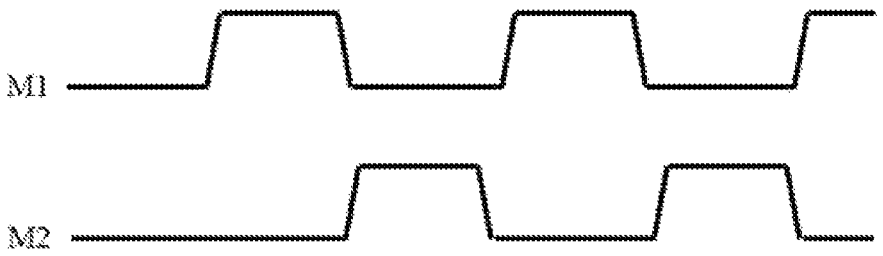
FIG. 3 is a waveform diagram showing a MUX control signal of FIG. 2.

FIG. 2 is a circuit diagram of a multiplexer of a flat panel display device according to a first embodiment of the present invention, and FIG. 3 is a waveform diagram showing a MUX control signal of FIG. 2.

FIG. 2 shows the circuit configuration of a 1:2 multiplexer for supplying the data voltage output from one channel of the data driving circuit 110 to two data lines. Accordingly, the configuration of FIG. 2 is configured in correspondence with each channel of the data driving circuit 110.

The 1:2 multiplexer for supplying the data voltage output from one channel of the data driving circuit 110 to two data lines includes four switching transistors T1 to T4, as shown in FIG. 2.

That is, the first switching transistor T1 and the second switching transistor T2 are connected to each other in parallel and are turned on or off by a first MUX control signal M1 to supply the data voltage output from one channel of the data driving circuit 110 to an i-th data line Di. In addition, the third switching transistor T3 and the fourth switching transistor T4 are connected to each other in parallel and are turned on or off by a second MUX control signal M2 to supply the data voltage output from one channel of the data driving circuit 110 to an (i+1)-th data line D(i+1).

When the first MUX control signal M1 is at a high level, the second MUX control signal M2 is maintained at a low level and, when the second MUX control signal M2 is at a high level, the first MUX control signal M1 is maintained at a low level.

The switching transistors T1 to T4 of the multiplexer may be PMOS transistors or NMOS transistors.

As described in FIGS. 2 and 3, since the MUX control signals M1 and M2 for driving the multiplexer 102 swing with a high frequency, switching noise and electromagnetic interference (EMI) noise frequently occur. It is difficult to achieve communication sensitivity and a set of frequency avoidance regions.

In addition, in the case of an in-cell touch flat panel display device, image quality defects caused by common voltage stabilization delay are generated by the MUX control signal.

In addition, as the number of MUX control signals increases, the problems become serious.

Accordingly, a method of reducing switching noise and EMI noise according to the MUX control signals M1 to Mk is proposed.

Figure 4:
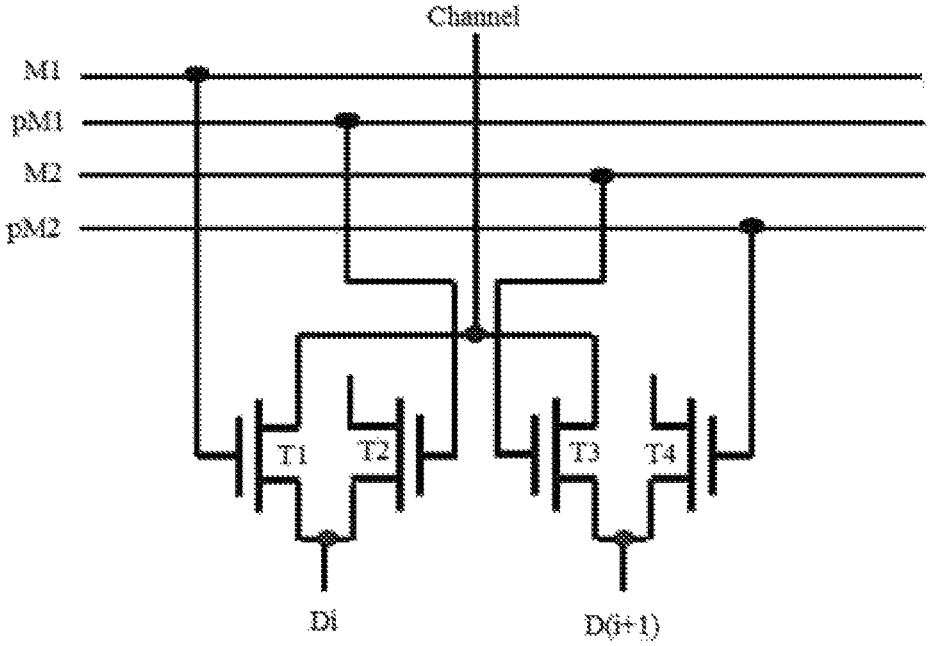
FIG. 4 is a circuit diagram of a multiplexer of a flat panel display device according to a second embodiment of the present invention.
Figure 5:
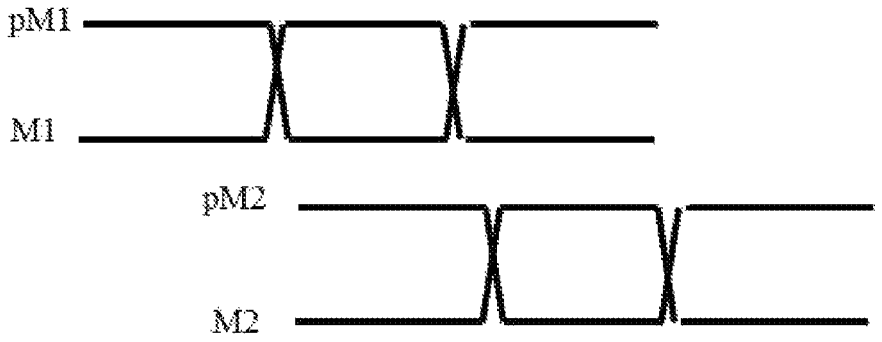
FIG. 5 is a waveform diagram showing a MUX control signal of FIG. 4.

FIG. 4 is a circuit diagram of a multiplexer of a flat panel display device according to a second embodiment of the present invention, and FIG. 5 is a waveform diagram showing a MUX control signal of FIG. 4.

FIG. 4 shows the circuit configuration of a 1:2 multiplexer for supplying the data voltage output from one channel of the data driving circuit 110 to two data lines. Accordingly, the configuration of FIG. 4 is configured in correspondence with each channel of the data driving circuit 110.

The 1:2 multiplexer according to the second embodiment of the present invention includes four switching transistors T1 to T4, as shown in FIG. 4.

That is, the first switching transistor T1 and the second switching transistor T2 form a first pair and the third switching transistor T3 and the fourth switching transistor T4 form a second pair.

The drain electrode of the first switching transistor T1 and the drain electrode of the second switching transistor T2 of the first pair are connected to each other and to an i-th data line Di. A first MUX control signal M1 is applied to the gate electrode of the first switching transistor T1, a first pseudo MUX control signal pM1 is applied to the gate electrode of the second switching transistor T2, the source electrode of the first switching transistor T1 is connected to the channel of the data driving circuit 110, and the source electrode of the second switching transistor T2 is floating.

The drain electrode of the third switching transistor T3 and the drain electrode of the fourth switching transistor T4 of the second pair are connected to each other and to an (i+1)-th data line D(i+1). A second MUX control signal M2 is applied to the gate electrode of the third switching transistor T3, a second pseudo MUX control signal pM2 is applied to the gate electrode of the fourth switching transistor T4, the source electrode of the third switching transistor T3 is connected to the channel of the data driving circuit 110, and the source electrode of the fourth switching transistor T4 is floating.

Accordingly, the first switching transistor T1 is turned on or off by the first MUX control signal M1 to supply a first data voltage output from one channel of the data driving circuit 110 to the i-th data line Di. In addition, the third switching transistor T3 is turned on or off by the second MUX control signal M2 to supply a second data voltage output from one channel of the data driving circuit 110 to the (i+1)-th data line D(i+1).

When the first MUX control signal M1 is at a high level, the second MUX control signal M2 is maintained at a low level and, when the second MUX control signal M2 is at a high level, the first MUX control signal M1 is maintained at a low level.

The first pseudo MUX control signal pM1 and the first MUX control signal M1 have the same frequency and the first pseudo MUX control signal pM1 has a phase opposite to that of the first MUX control signal.

In addition, the second pseudo MUX control signal pM2 and the second MUX control signal M2 have the same frequency and the second pseudo MUX control signal pM2 has a phase opposite to that of the second MUX control signal.

Here, the falling edge of the first MUX control signal and the rising edge of the second MUX control signal have a predetermined time interval.

The signal lines for supplying the first and second MUX control signals M1 and M2 and the first and second pseudo MUX control signals pM1 and pM2 are formed on the non-display region of the display panel in a line on glass (LOG) type.

Accordingly, as shown in FIG. 5, the falling edge of the first MUX control signal M1 coincides with the rising edge of the first pseudo MUX control signal pM1, the rising edge of the first MUX control signal M1 coincides with the falling edge of the first pseudo MUX control signal pM1, the falling edge of the second MUX control signal M2 coincides with the rising edge of the second pseudo MUX control signal pM2, and the rising edge of the second MUX control signal M2 coincides with the falling edge of the second pseudo MUX control signal pM2.

Accordingly, since the rising edges and the falling edges of the first and second MUX control signals M1 and M2 are canceled by the first and second pseudo MUX control signals pM1 and pM2, respectively, it is possible to prevent switching and EMI noises from being generated by the first and second MUX control signals and to prevent image quality defects caused by common voltage stabilization delay.

Although the circuit configuration of the 1:2 multiplexer for supplying the data voltage output from one channel of the data driving circuit 110 to two data lines is described in FIGS. 4 and 5, the present invention is not limited thereto. In the flat panel display device of the present invention, a 1:3, 1:4 or 1:k multiplexer for supplying the data voltage output from one channel of the data driving circuit 110 to three or more data lines may be configured.

Figure 6:
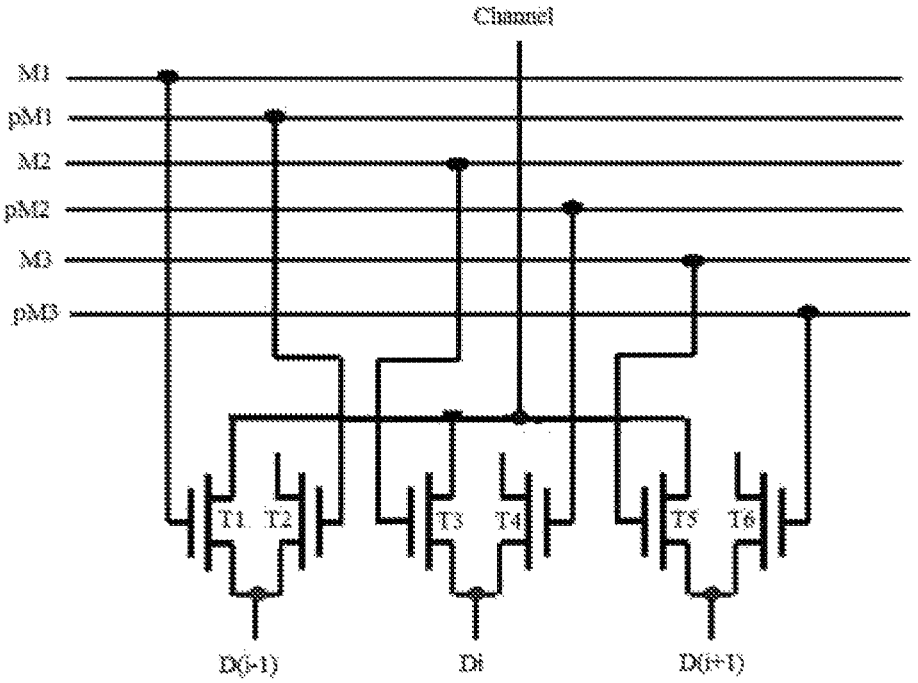
FIG. 6 is a circuit diagram of a multiplexer of a flat panel display device according to a third embodiment of the present invention.
Figure 7:
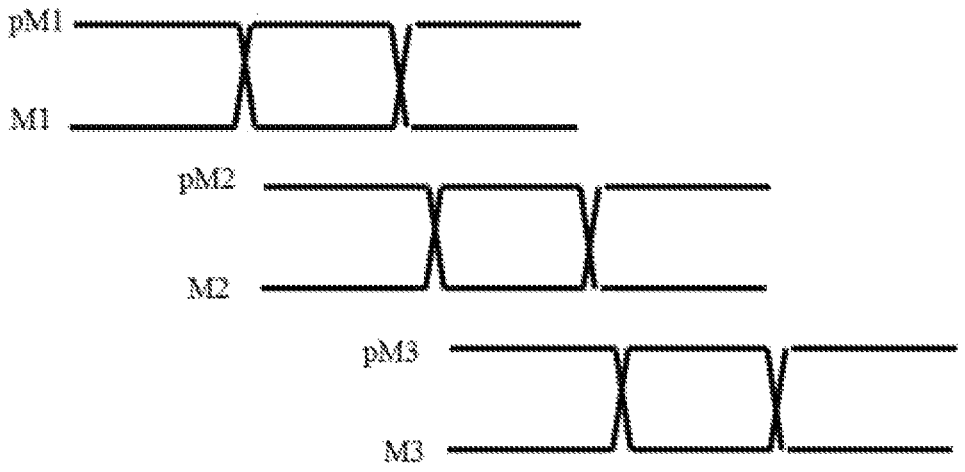
FIG. 7 is a waveform diagram showing a MUX control signal of FIG. 6.

FIG. 6 is a circuit diagram of a multiplexer of a flat panel display device according to a third embodiment of the present invention, and FIG. 7 is a waveform diagram showing a MUX control signal of FIG. 6.

FIG. 6 shows the circuit diagram of the 1:3 multiplexer for supplying first to third data voltages output from one channel of the data driving circuit 110 to three data lines.

Accordingly, the configuration shown in FIG. 6 is configured in correspondence with each channel of the data driving circuit 110.

The 1:3 multiplexer according to the third embodiment of the present invention includes six switching transistors T1 to T6, as shown in FIG. 6.

That is, the first switching transistor T1 and the second switching transistor T2 form a first pair, the third switching transistor T3 and the fourth switching transistor T4 form a second pair, and the fifth switching transistor T5 and the sixth switching transistor T6 form a third pair.

The drain electrode of the first switching transistor T1 and the drain electrode of the second switching transistor T2 of the first pair are connected to each other and to an (i−1)th data line D(i−1). A first MUX control signal M1 is applied to the gate electrode of the first switching transistor T1, a first pseudo MUX control signal pM1 is applied to the gate electrode of the second switching transistor T2, the source electrode of the first switching transistor T1 is connected to the channel of the data driving circuit 110, and the source electrode of the second switching transistor T2 is floating.

The drain electrode of the third switching transistor T3 and the drain electrode of the fourth switching transistor T4 of the second pair are connected to each other and to an i-th data line Di. A second MUX control signal M2 is applied to the gate electrode of the third switching transistor T3, a second pseudo MUX control signal pM2 is applied to the gate electrode of the fourth switching transistor T4, the source electrode of the third switching transistor T3 is connected to the channel of the data driving circuit 110, and the source electrode of the fourth switching transistor T4 is floating.

The drain electrode of the fifth switching transistor T5 and the drain electrode of the sixth switching transistor T6 of the third pair are connected to each other and to an (i+1)-th data line D(i+1). A third MUX control signal M3 is applied to the gate electrode of the fifth switching transistor T5, a third pseudo MUX control signal pM3 is applied to the gate electrode of the sixth switching transistor T6, the source electrode of the fifth switching transistor T5 is connected to the channel of the data driving circuit 110, and the source electrode of the sixth switching transistor T6 is floating.

Accordingly, the first switching transistor T1 is turned on or off by the first MUX control signal M1 to supply a first data voltage output from one channel of the data driving circuit 110 to the (i−1)-th data line D(i−1).

The third switching transistor T3 is turned on or off by the second MUX control signal M2 to supply a second data voltage output from one channel of the data driving circuit 110 to the i-th data line Di.

The fifth switching transistor T5 is turned on or off by the third MUX control signal M3 to supply a third data voltage output from one channel of the data driving circuit 110 to the (i+1)-th data line D(i+1).

When the first MUX control signal M1 is at a high level, the second and third MUX control signals M2 and M3 are maintained at a low level. When the second MUX control signal M2 is at a high level, the first and third MUX control signals M1 and M3 are maintained at a low level. When the third MUX control signal M3 is at a high level, the first and second MUX control signals M1 and M2 are maintained at a low level.

The first pseudo MUX control signal pM1 and the first MUX control signal M1 have the same frequency and the first pseudo MUX control signal pM1 has a phase opposite to that of the first MUX control signal.

In addition, the second pseudo MUX control signal pM2 and the second MUX control signal M2 have the same frequency and the second pseudo MUX control signal pM2 has a phase opposite to that of the second MUX control signal.

In addition, the third pseudo MUX control signal pM3 and the third MUX control signal M3 have the same frequency and the third pseudo MUX control signal pM3 has a phase opposite to that of the third MUX control signal.

Here, the falling edge of the first MUX control signal and the rising edge of the second MUX control signal have a predetermined time interval, and the falling edge of the second MUX control signal and the rising edge of the third MUX control signal have a predetermined time interval.

The signal lines for supplying the first to third MUX control signals M1, M2 and M3 and the first to third pseudo MUX control signals pM1, pM2 and pM3 are formed on the non-display region of the display panel in a line on glass (LOG) type.

Accordingly, as shown in FIG. 7, the falling edge of the first MUX control signal M1 coincides with the rising edge of the first pseudo MUX control signal pM1, and the rising edge of the first MUX control signal M1 coincides with the falling edge of the first pseudo MUX control signal pM1. The falling edge of the second MUX control signal M2 coincides with the rising edge of the second pseudo MUX control signal pM2, and the rising edge of the second MUX control signal M2 coincides with the falling edge of the second pseudo MUX control signal pM2. In addition, the falling edge of the third MUX control signal M3 coincides with the rising edge of the third pseudo MUX control signal pM3 and the rising edge of the third MUX control signal M3 coincides with the falling edge of the third pseudo MUX control signal pM3.

Accordingly, by the first to third pseudo MUX control signals pM1, pM2 and pM3, it is possible to prevent switching and EMI noises from being generated by the first to third MUX control signals and to prevent image quality defects caused by common voltage stabilization delay.

If the circuit of the 1:k multiplexer for supplying the data voltage output from one channel of the data driving circuit 110 to k data lines is configured using the method described in FIGS. 4 to 7, 2k switching transistors are provided, the 2k switching transistors are grouped into k pairs, one of two switching transistors of each pair supplies the data voltage output from the channel of the data driving circuit to one data line by a MUX control signal, and a pseudo MUX control signal is applied to the other switching transistor. By pseudo MUX control signals, it is possible to prevent switching and EMI noises from being generated by the first to kth MUX control signals and to prevent image quality defects caused by common voltage stabilization delay.

The flat panel display device according to the present invention having the above features has the following effects.

According to the second and third embodiments of the present invention, since one multiplexer for selectively supplying a data signal supplied from one output channel of a data driving circuit to k data lines includes 2k switching transistors forming k pairs, one of the two switching transistors of each pair supplies the data voltage output from the channel of the data driving circuit to one data line by a MUX control signal, a pseudo MUX control signal having a phase opposite to that of the MUX control signal is applied to the other switching transistor, and the rising and falling edges of the MUX control signal are canceled by the falling and rising edges of the pseudo MUX control signal.

Accordingly, it is possible to prevent switching and electromagnetic interference noises from being generated by the MUX control signals and to prevent image quality defects caused by common voltage stabilization delay.

Those skilled in the art will appreciate that various modifications and variations can be made in the present invention without departing from the spirit or scope of the invention described in the appended claims. Accordingly, the invention should not be limited to the specific embodiments described herein, but the scope thereof should be defined by the claims.

What is claimed is:

1. A flat panel display device comprising:

a display panel including a plurality of gate lines and a plurality of data lines;

a data driving circuit configured to supply data signals to each of the plurality of data lines of the display panel; and a multiplexer controlled by k MUX control signals and k pseudo MUX control signals to selectively supply data signals from one output channel of the data driving circuit to k data lines, wherein k is a natural number equal to or greater than 2, wherein the multiplexer includes k pairs of switching transistors, each pair of switching transistors comprising:

a first switching transistor controlled by one of the k MUX control signals to supply a data signal output from the one output channel of the data driving circuit to one data line, and a second switching transistor controlled by one of the k pseudo MUX control signals having a phase opposite to that of the one of the k MUX control signals, wherein, for each pair of switching transistors, a drain electrode of the first switching transistor and a drain electrode of the second switching transistor are connected to each other and to a corresponding data line, one of the k MUX control signals is applied to a gate electrode of the first switching transistor, one of the k pseudo MUX control signals is applied to a gate electrode of the second switching transistor, a source electrode of the first switching transistor is connected to the one output channel of the data driving circuit, and a source electrode of the second switching transistor is floating.

2. The flat panel display device according to claim 1, wherein the multiplexer is controlled by first and second MUX control signals, and first and second pseudo MUX control signals to selectively supply the data signals supplied from one output channel of the data driving circuit to a first and second data lines, wherein the multiplexer includes a first and second pairs of switching transistors, a first switching transistor of the first pair of switching transistors supplies a first data signal output from the one output channel of the data driving circuit to the first data line based on the first MUX control signal, and a first switching transistor of the second pair of switching transistors supplies a second data signal output from the one channel of the data driving circuit to the second data line based on the second MUX control signal, and wherein the first pseudo MUX control signal is applied to a second switching transistor of the first pair of switching transistors, and the second pseudo MUX control signal is applied to a second switching transistor of the second pair of switching transistors.

3. The flat panel display device according to claim 2, wherein a drain electrode of the first switching transistor of the first pair of switching transistors and a drain electrode of the second switching transistor of the first pair of switching transistors are connected to each other and to the first data line, the first MUX control signal is applied to a gate electrode of the first switching transistor of the first pair of switching transistors, the first pseudo MUX control signal is applied to a gate electrode of the second switching transistor of the first pair of switching transistors, a source electrode of the first switching transistor of the first pair of switching transistors is connected to the one output channel of the data driving circuit, and a source electrode of the second switching transistor of the first pair of switching transistors is floating.

4. The flat panel display device according to claim 3, wherein a drain electrode of the first switching transistor of the second pair of switching transistors and a drain electrode of the second switching transistor of the second pair of switching transistors are connected to each other and to the second data line, the second MUX control signal is applied to a gate electrode of the first switching transistor of the second pair of switching transistors, the second pseudo MUX control signal is applied to a gate electrode of the second switching transistor of the second pair of switching transistors, a source electrode of the first switching transistor of the second pair of switching transistors is connected to the one output channel of the data driving circuit, and a source electrode of the second switching transistor of the second pair of switching transistors is floating.

5. The flat panel display device according to claim 2, wherein a falling edge of the first MUX control signal and a rising edge of the second MUX control signal have a predetermined time interval.

6. The flat panel display device according to claim 2, wherein the first pseudo MUX control signal has a phase opposite to that of the first MUX control signal, and the second pseudo MUX control signal has a phase opposite to that of the second MUX control signal.

7. The flat panel display device according to claim 2, wherein the first MUX control signal and the first pseudo MUX control signal have a same frequency, and the second MUX control signal and the second pseudo MUX control signal have the same frequency.

8. The flat panel display device according to claim 2, wherein a falling edge and a rising edge of the first MUX control signal respectively coincides with a rising edge and a falling edge of the first pseudo MUX control signal, and a falling edge and a rising edge of the second MUX control signal respectively coincides with a rising edge and a falling edge of the second pseudo MUX control signal.

9. The flat panel display device according to claim 2, wherein a rising edge and a falling edge of the first and second MUX control signals are respectively cancelled by the first and second pseudo MUX control signals.

10. The flat panel display device according to claim 1, wherein the multiplexer is controlled by first to third MUX control signals and first to third pseudo MUX control signals to selectively supply the data signals supplied from one output channel of the data driving circuit to first to third data lines, wherein the multiplexer includes first to third pairs of switching transistors, a first switching transistor of the first pair of switching transistors supplies a first data signal output from the one output channel of the data driving circuit to the first data line based on the first MUX control signal, a first switching transistor of the second pair of switching transistors supplies a second data signal output from the one output channel of the data driving circuit to the second data line based on the second MUX control signal, and a first switching transistor of the third pair of switching transistors supplies a third data signal output from the one output channel of the data driving circuit to the third data line based on the third MUX control signal, and wherein the first pseudo MUX control signal is applied to a second switching transistor of the first pair of switching transistors, the second pseudo MUX control signal is applied to a second switching transistor of the second pair of switching transistors, and the third pseudo MUX control signal is applied to a second switching transistor of the third pair of switching transistors.

11. The flat panel display device according to claim 10, wherein a drain electrode of the first switching transistor of the first pair of switching transistors and a drain electrode of the second switching transistor of the first pair of switching transistors are connected to each other and to the first data line, the first MUX control signal is applied to a gate electrode of the first switching transistor of the first pair of switching transistors, the first pseudo MUX control signal is applied to a gate electrode of the second switching transistor of the first pair of switching transistors, a source electrode of the first switching transistor of the first pair of switching transistors is connected to the one output channel of the data driving circuit, and a source electrode of the second switching transistor of the first pair of switching transistors is floating, wherein a drain electrode of the first switching transistor of the second pair of switching transistors and a drain electrode of the second switching transistor of the second pair of switching transistors are connected to each other and to the second data line, the second MUX control signal is applied to a gate electrode of the first switching transistor of the second pair of switching transistors, the second pseudo MUX control signal is applied to a gate electrode of the second switching transistor of the second pair of switching transistors, a source electrode of the first switching transistor of the second pair of switching transistors is connected to the one output channel of the data driving circuit, and a source electrode of the second switching transistor of the second pair of switching transistors is floating, and wherein a drain electrode of the first switching transistor of the third pair of switching transistors and a drain electrode of the second switching transistor of the third pair of switching transistors are connected to each other and to the third data line, the third MUX control signal is applied to a gate electrode of the first switching transistor of the third pair of switching transistors, the third pseudo MUX control signal is applied to a gate electrode of the second switching transistor of the third pair of switching transistors, a source electrode of the first switching transistor of the third pair of switching transistors is connected to the one output channel of the data driving circuit, and a source electrode of the second switching transistor of the third pair of switching transistors is floating.

12. The flat panel display device according to claim 10, wherein a falling edge of the first MUX control signal and a rising edge of the second MUX control signal have a predetermined time interval, and a falling edge of the second MUX control signal and a rising edge of the third MUX control signal have a predetermined time interval.

13. The flat panel display device according to claim 10, wherein the first pseudo MUX control signal has a phase opposite to that of the first MUX control signal, the second pseudo MUX control signal has a phase opposite to that of the second MUX control signal, and the third pseudo MUX control signal has a phase opposite to that of the third MUX control signal.

14. The flat panel display device according to claim 10, wherein the first MUX control signal and the first pseudo MUX control signal have a same frequency, the second MUX control signal and the second pseudo MUX control signal have the same frequency, and the third MUX control signal and the third pseudo MUX control signal have the same frequency.

15. The flat panel display device according to claim 10, wherein a falling edge and a rising edge of the first MUX control signal respectively coincides with a rising edge and a falling edge of the first pseudo MUX control signal, a falling edge and a rising edge of the second MUX control signal respectively coincides with a rising edge and a falling edge of the second pseudo MUX control signal, and a falling edge and a rising edge of the third MUX control signal respectively coincides with a rising edge and a falling edge of the third pseudo MUX control signal.

16. The flat panel display device according to claim 10, wherein a rising edge and a falling edge of the first to third MUX control signals are respectively cancelled by the first to third pseudo MUX control signals.

17. The flat panel display device according to claim 1, wherein signal lines for supplying the k MUX control signals and the k pseudo MUX control signals are formed on a non-display region of the display panel in a line on glass (LOG) type.

* * * * *